US008156570B1

(12) United States Patent
Hockaday

(10) Patent No.: US 8,156,570 B1
(45) Date of Patent: Apr. 17, 2012

(54) HELMET AND BODY ARMOR ACTUATED VENTILATION AND HEAT PIPES

(76) Inventor: Robert G. Hockaday, Los Alamos, NM (US)

( * ) Notice: Subject to any disclaimer, the term of this patent is extended or adjusted under 35 U.S.C. 154(b) by 589 days.

(21) Appl. No.: 12/321,861

(22) Filed: Jan. 26, 2009

Related U.S. Application Data

(60) Provisional application No. 61/062,219, filed on Jan. 24, 2008.

(51) Int. Cl.
*A42B 3/28* (2006.01)

(52) U.S. Cl. ..... 2/7; 428/154

(58) Field of Classification Search ..... None
See application file for complete search history.

(56) References Cited

U.S. PATENT DOCUMENTS

| | | | | |
|---|---|---|---|---|
| 3,751,727 | A * | 8/1973 | Shepard et al. | 2/2.14 |
| 4,130,902 | A * | 12/1978 | Mackenroth et al. | 2/7 |
| 4,483,021 | A * | 11/1984 | McCall | 2/7 |
| 5,146,757 | A * | 9/1992 | Dearing | 62/61 |
| 5,421,326 | A * | 6/1995 | Rankin et al. | 128/201.19 |
| 5,564,124 | A * | 10/1996 | Elsherif et al. | 2/69 |
| 5,655,374 | A * | 8/1997 | Santilli et al. | 62/3.5 |
| 5,709,203 | A * | 1/1998 | Gier | 128/201.21 |
| 6,081,929 | A * | 7/2000 | Rothrock et al. | 2/171.3 |
| 6,772,448 | B1 | 8/2004 | Hockaday et al. | |
| 7,017,191 | B2 | 3/2006 | Golde | |
| 7,207,071 | B2 | 4/2007 | Pierce | |
| 2001/0003907 | A1 | 6/2001 | Siman-Tov et al. | |
| 2002/0134809 | A1 | 9/2002 | Angus | |
| 2003/0045918 | A1 | 3/2003 | Turner et al. | |
| 2004/0105070 | A1* | 6/2004 | Hockaday et al. | 351/156 |
| 2004/0168459 | A1* | 9/2004 | Blackstone | 62/259.2 |
| 2005/0010996 | A1* | 1/2005 | Steinert | 2/458 |
| 2005/0193742 | A1 | 9/2005 | Arnold | |
| 2005/0246826 | A1 | 11/2005 | McCarter et al. | |
| 2006/0191049 | A1* | 8/2006 | Elkins et al. | 2/7 |
| 2006/0276552 | A1 | 12/2006 | Barbut et al. | |
| 2007/0028372 | A1 | 2/2007 | Van Der Woude et al. | |
| 2007/0123813 | A1 | 5/2007 | Barbut et al. | |
| 2007/0151121 | A1 | 7/2007 | Touzov | |
| 2007/0184238 | A1* | 8/2007 | Hockaday et al. | 428/98 |
| 2007/0204974 | A1 | 9/2007 | Gupta et al. | |

FOREIGN PATENT DOCUMENTS

| | | |
|---|---|---|
| WO | WO/97/06396 | 2/1997 |

* cited by examiner

*Primary Examiner* — Brian D Nash
(74) *Attorney, Agent, or Firm* — James Creighton Wray

(57) ABSTRACT

The lack of air flow under body armor, helmets, and thick garments can lead to excessive moisture build up and discomfort on the wearers body due to lack of heat removal and effective evaporation of sweat. By incorporating wick covered heat pipes or thermal conductors with air flow channels in the apparel contact area between the garments, helmets, and body armor the effectiveness air flow cooling and evaporation of sweat can be restored. Humidity or temperature auto-actuated bi-material valves are used to control this air-moisture-heat flow to achieve a controlled comfortable humidity-temperature environment and avoid excessive cooling. Supplementary air pumps, filters, dehydrators, fluid pumps, heating fluids, and cooling fluids may be incorporated to enhance the effectiveness. Biocides and hydrophilic materials are also incorporated on the wick coverings to avoid biological growth and maintain performance to achieve a healthy environment for the wearer.

29 Claims, 6 Drawing Sheets

HELMET AND BODY ARMOR ACTUATED VENTILATION AND HEAT PIPES

This application claims the benefit of U.S. Provisional Application No. 61/062,219, filed Jan. 24, 2008, which is hereby incorporated by reference in its entirety.

SUMMARY OF THE INVENTION

The invention provides apparatus to control the movement of heat and moisture and control temperature and humidity, by evaporation and air cooling with air flow between an armor shell, apparel, or helmet covering human or animal body using; air flow channels, water wicking material covered heat pipes, or thermal conductors in contact with human or animal body and humidity and/or temperature reactive auto-actuated laminate impedance structures or humidity and/or temperature reactive auto-actuated laminate valves.

The invention provides apparatus to control the movement of heat and chemicals and thereby control temperature and humidity, by evaporation and air cooling with fluid flow between a cover over a living body using fluid flow channels, liquid wicking material covered thermal conduits in contact with living body, and chemical concentration and/or temperature reactive auto-actuated laminate structures with varying impedance to the movement of heat and chemicals.

The invention provides apparatus to control heat and moisture flux to control temperature and humidity environment, by evaporation and air cooling with airflow between an armor shell, apparel, or helmet covering a living body using; air flow channels, water wicking material covered thermal conduits in contact with body, and humidity and/or temperature reactive auto-actuated laminate impedance structures which therein vary impedance to the flux of heat, moisture and/or fluid flow.

Elements:

- remove heat and chemicals, or moisture
- control temperature and humidity,
- evaporation and air cooling with air flow between an armor shell, apparel, or helmet covering
- air flow channels
- chemical concentration and/or temperature reactive auto-actuated laminate structures which control heat and air flow
- wicking material covered heat thermal conduits, heat pipes, or conductor which is also in contact with the human, animal, or living body.

The use of body armor, helmets, fire proof suits, hazardous environment suits, cock pit shells, thick garments, shoes, and gloves on people such as motor cross racing drivers, racing car drivers, soldiers, police, and firefighters can lead to excessive temperatures on the wearers body. The human body reaction to maintain constant temperature is to sweat and cool by evaporation on the skin. Due to the confined conditions and lack of air circulation under the armor the sweating does not result in evaporation and effective cooling of the wearer. Thus sweat builds up under the armor and the wearer becomes uncomfortable, this can result in dehydration, in some situations even possibly lead to hyperthermia or hypothermia. In addition the moist and warm conditions on the skin are ideal growth conditions for bacterial growth and can lead to skin and wound infections of the wearers. Body oils from the wearer can also interfere with efficient wicking of sweat. In cold weather environments excessive cooling through body armor can also lead to an opposite situation of chilling the wearer of the armor.

The disclosed invention is to provide a means of wicking sweat off the body and skin onto a wicking surface covering the padding or of the of the body armor, and creating air flow passages in the padding of the helmet or body armor to allow for effective cooling by evaporation of the sweat from the wearer. Padding contact and confinement of the body armor interferes with the normal evaporative cooling of sweating and evaporation to air flow. By placing thermally conductive materials, or heat pipes inside the padding to transfer heat on contact with the body and with the evaporating sweat areas onto the wicking surfaces it restores the cooling effect of sweating. To provide optimum heat removal control to maintain desirable temperatures and humidity surrounding the wearer, humidity or temperature bi-material laminate actuating valves open to let air flow when temperatures or humidity are high to maximize air flow and evaporation and close when the temperatures are low or humidity is low to retain heat and maintain a comfortable environment about the wearer. The laminate actuators can be distributed through out the air vent channels under the body armor to achieve local control thereby uniformly maintaining desirable environmental conditions through out the apparel. Laminate actuators in the form of exterior layers or fabric can be used to cover the exterior of the body armor or helmet to act as self adjusting variable thermal insulation and ventilation to the body armor and thermally conductive elements. To insure the cooling effect of flowing air in high humidity environments water absorbent and heat dissipation an air intake filter be used to de-humidify the air flow entering the system. The air intake filter can also be an insect, dust and/or bacterial filter to keep the air flow space inside the armor clean. An air fan can be used to pump air through the system when the system is stationary or high power cooling performance is needed or the air flow resistance into passages will not allow sufficient evaporative cooling to be effective. The padding and wicking surfaces can be treated with antibacterial coating to prevent fungal and bacterial growth. Water can be distributed to the evaporating areas with tubes or membranes onto of the thermal conductors or heat pipes for additional cooling. This patent application incorporates laminated actuators of our filed patent application U.S. Ser. No. 11/702,821, filed Feb. 6, 2007, based on U.S. Provisional Application 60/765,607, filed Feb. 6, 2006 "Laminate Actuators and Valves" as if fully set forth herein as an air and heat flow control mechanism because of their simplicity, unique low mass and structural formability to be incorporated into apparel.

PRIOR ART

Hockaday Robert, et al. U.S. Pat. No. 6,772,448 B1 "Non-Fogging Goggles" Our patent describes using heat pipes to move body heat to heat the lens of a goggle. This patent describes using a water absorbent on the vents. It does describe using wicking sweat from the body contact but it does not describe using the evaporative cooling on the exterior of the heat pipe to cool the body or using actuated vents to regulate the flow air to achieve regulated body cooling.

Pierce Brendan U.S. Pat. No. 7,207,071 "Ventilated helmet system" This is an example of ribbed passageways for air flow in a helmet. This patent describes placing a dust air filter in the incoming air flow. Porous hydrophilic foam in contact with the wearer is described. Wicking with a cloth liner is described. Using the venturi effect and convective effect to draw air is described. He describes a need for metering the air flow, but does not show a method of doing this besides the passive air flow effects.

Golde Paul U.S. Pat. No. 7,017,191"Ventilated protective garment" is an example of a ventilated garment using air flow passageways and aerodynamic ventilation of the garment.

Uses an air permeable panel and a ventilation slit that can be opened and closed. This patent does describe the need to able to change the ventilation and cooling with changing environment around motorcycle riders wearing helmets and leather riding suits. This patent does not describe auto actuation on humidity or temperature of the open and closing of the ventilation slit.

VanDerWoude Brian et al. US Patent application 20070028372"Medical/surgical personal protection system providing ventilation, illumination and communication" is an example of a helmet for medical personal ventilation with a sterile barrier around medical personnel. It uses a ventilation fan. This patent does not describe auto actuation on humidity or temperature control of the ventilation system, but does provide fan flow volume control with electronic control button controls.

Arnold Anthony Peter US Patent 20050193742 "Personal heat control device and method" is a personal cooling of protective head gear. They use heat pipes in the foam pads. Thermoelectric on garments is the primary claim. This patent application does not use air flow for cooling or describe evaporative cooling coupled with the heat pipes.

Barbut Denise et al. US patent applications 20070123813 and 20060276552 "Methods and devices for non-invasive cerebral cooling and systemic cooling" Describes heat pipes that are used to cerebral cooling with heat pipes inserted into the nasal cavity. They also describe using a pump to move evaporating cooling fluids into the lumens cavities inside the body. This patent application does not describe using auto actuation with humidity or temperature to control the cooling.

Simon-Toy Moshe et al. US patent application 20010003907 "Personal Cooling Apparatus and Method" Uses thermal conductors, such as graphite fibers, in contact with living body, uses wicking of sweat, antimicrobial coatings, and incorporates automatic integrated thermostat control of air flow device. It does mention a variety of air flow mechanisms fans, and convective air flow. This patent application does not use auto actuation bi-material laminate actuator valves or heat pipes.

Angus June, et al. US patent application 20020134809 "Waist Pouch" Uses moisture heat and air flow channels, wicking to evaporative cooling remote from the site of the sweating. This patent application does not use heat pipes, or auto actuation laminate actuated valves to control air flow.

Gupta Ramesh, et al. US patent application 20070204974 "Heat pipe with controlled fluid charge" is a heat pipe system that uses a controlled amount of mass working fluid to control the upper temperature limit on heat pipes heat transfer at high temperatures. This patent application does not integrate the heat pipe into apparel or animal contact.

Turner David, et al. US Patent application 20030045918 "Apparel Ventilation System" David Turner uses pressurized air flow in channels in helmets and apparel to achieve cooling. This patent application used a pressurized bladder and a plurality of air flow channels and openings in wearer contact in apparel for ventilation. Providing sufficient air ventilation for wearer's body to regulate their temperature. This patent application does describe using the perspiration of the user combined with air flow as a body's natural cooling mechanism. It also describes wicking perspiration away. This patent application describes using compressed warm or cool air as the air flow source. This patent application does not describe an auto thermal or humidity actuated air flow control system.

McCarter Walter K., et al. US Patent application 20050246826 "Cooling Garment for Use with a Bullet Proof Vest" This patent application teaches using air ribbed air flow channels under armor. Excessive sweating of wearer can lead to discomfort, skin irritation and dehydration. This device uses a detachable fan to move air flow. This patent application describes using water resistant surface coatings. This patent application does not describe an auto thermal or humidity actuated air flow control system.

Touzov; Igor Victorovich US patent application 20070151121 "Stretchable and transformable planar heat pipe for apparel and footwear, and production method thereof" This patent describes a stretchable heat pipe made of polymers and rubbers used inside shoes and apparel. It uses the effect of boiling point set by the atmospheric pressure surrounding the heat pipe, thereby reducing the transfer of heat when the body contact is bellow the boiling point of the heat pipe. This invention describes using the heat pipe in conjunction with socks and the heat pipe extending out of the apparel into the atmosphere. This heat pipe system does not describe using the wicking covering on the heat pipe and evaporative cooling on the heat pipe outer surfaces or using humidity or thermal or humidity auto actuated valve to control air flow or cooling of the heat pipe.

Clodic Denis WO/1997/006396 PCT/FR96/01270 "Footwear or clothing article with integral thermal regulation element" This patent describes a heat pipe that moves heat from relatively warm regions of the body to cooler regions of the body and the exterior atmosphere. It does describe an air circulating channel supplies forces air flow underneath the heat pipe. This patent application does not describe using auto thermal or humidity actuated air flow control system.

Figure 1:
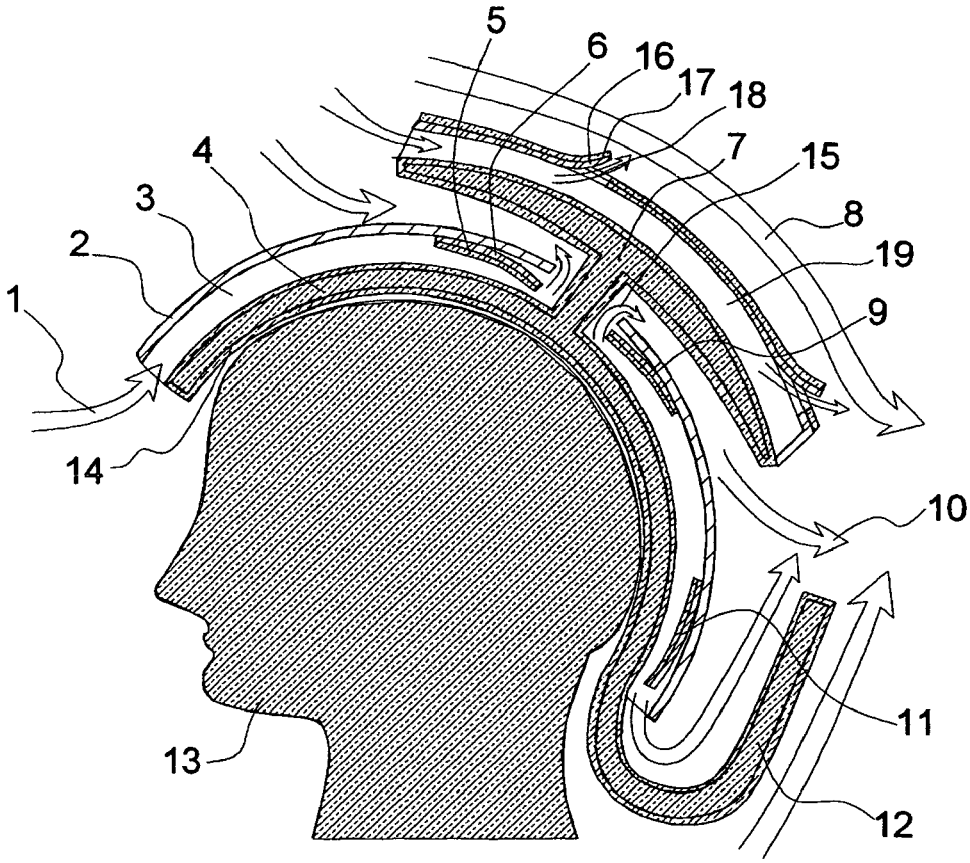
FIG. 1 Cross Sectional View of Heat Removal System for Helmet

1. Air into helmet channels
2. Helmet
3. Air flow channels in the padding and heat pipe
4. Heat pipe with fluid
5. Layer that expands with humidity
6. Substrate layer of the actuator that can bend
7. Condensation and heat delivery area of the heat pipe
8. Air flow over the exterior of the heat pipe and helmet
9. Laminate actuator
10. Air flow exiting the helmet
11. Laminate actuator
12. Heat pipe and wick out of the rim of the helmet
13. Head of the wearer
14. Wicking material covering the heat pipe
15. Hole in helmet
16. Thermal expansion layer actuating flap valve
17. Substrate layer bending
18. Aperture with air flowing through
19. Air Space FIG. 2 Wick Covered Heat Pipe

20. Sweat from body and skin of wearer
21. Evaporation and wicking of sweat and water
22. Boiling of working fluid of heat pipe
23. Wicking onto surface of heat pipe
24. Heat pipe wall, impermeable to the working fluid
25. Wicking material inside heat pipe
26. Condensing working fluid inside heat pipe
27. Working liquid fluid inside the heat pipe
28. Body and skin of wearer FIG. 3 Actuated Vents with Heat Pipe

35. Sweat wicking off wearer
36. Inlet moisture absorbent
37. Inlet air flow
38. Helmet, shell, armor or apparel exterior

39. Working fluid bubble
40. Condensed Working fluid
41. Wicking material or cloth exterior of heat pipe in thermal contact
42. Sweat or water on exterior of heat pipe
43. Airflow exit aperture
44. Air flowing out of exit aperture
45. Humidity or temperature expansion layer of the laminate actuator
46. Substrate layer of the laminate actuator
47. Working fluid of the heat pipe
48. Inner wicking material or cloth inside the heat pipe
49. Wall of heat pipe
50. Sweat of wearers skin
51. body of wearer
52. Fan or air pump
53. Exterior cooling fins on dehydrator
54. Biocide coating or particles (anti bacterial or anti fungus material)
55. Airflow channel FIG. 4 Actuated Air Flow with Thermally Conductive Wicking Padding

60. Fan
61. Moisture absorbent
62. Airflow thru the absorbent and air flow into the channels of the padding
63. Helmet, armor, apparel, or structure wall.
64. Sweat
65. Exit of apertures
66. Exit air flow
67. Expansion laminate material
68. Substrate laminate material
69. Thermally conductive padding in helmet
70. Wicking material or fabric
71. Sweat on body
72. Body
73. Sweat wicking onto exterior wick of pads
74. Cooling fins of de-hydrator
75. Biocide coating or particles
76. Channels in padding
77. Network filter or electrostatic filter FIG. 5 Actuated Air Flow Cooling System With Supplemental Water Distribution and Body Contact Layer.

90. Heat fins on dehydrator
91. Absorbent beads
92. Filter network or electrostatic filter electret fins or sheets
93. Air flow
94. Shell of armor
95. Evaporating water or wick on thermal conductive padding
96. Air flow channel
97. Water wick pore or diffusion pore
98. Vapor diffusion route or pore
99. Supplemental water
100. Exit air flow aperture
101. Exit air flow
102. Expansion or contraction layer of actuator
103. Substrate film of actuator
104. Membrane water permeable, or impermeable, fabric layer, or garment
105. Biocide treatment or salt or water vapor reducing film
106. Thermally conductive padding
107. Sweat from human on wearer side of layer
108. Sweat on wearer
109. Water on thermally conductive padding side of layer
110. Wearer
111. Water on thermal conductive padding side of membrane or fabric layer
112. Fan.
113. Wicking material on thermal conductor
114. Tubing
130. Pump and bladder
131. Supplemental cooling fluid FIG. 6 Laminate Actuator Valve

115. Shelf in aperture
116. Aperture
117. Expansion layer
118. Notch in actuator
119. Actuating flap
120. Second actuating flap
121. Substrate layer
122. Expansion or contraction layer
123. Cut in laminate
124. Cut in laminate
125. Cut in laminate

DETAILED DESCRIPTION OF THE PREFERRED EMBODIMENTS

Several typical embodiments of the invention are illustrated in the following frames. In these drawings several variations in assembly and arrangements will be shown. Please note that the drawings are drawn disproportionately to illustrate the physical features of this invention. In FIG. 1 a cross sectional view of helmet on a human head is shown. In a typical application the protective shell or helmet 2 is made of Kevlar and polyester resin lamination or steel. The padding 4 on the head of the human 13 is open cell urethane or closed cell neopream foam with a silk covering over the urethane foam. Inside the padding are flexible or rigid heat pipes. Rigid heat pipes 4 can be formed out of stainless steel or copper and the working fluid can be water, butane, or fluorocarbons such as perfluorhexane, 2-methyl perfluorpentane 1,1 difluroethane, 1,1,1,2-tetrafluroethane. Flexible heat pipes 4,7,12 can be formed out of aluminum foil sandwiched between polyester and polypropylene laminate, which typically are used to encapsulate lithium ion batteries. The working fluid in the flexible heat pipe 4,7,12 is chosen to have a boiling point at atmospheric pressure since the flexible heat pipe will be at a pressure of the surrounding atmosphere due to the flexible walls and ability to change volume, at comfortable temperature such as 28° C. of pentane. An example of a non-combustible and non-toxic working fluid is trichloromonofluomethane (Freon 11) with a boiling point of 23.8° C. The amount of working fluid in the flexible heat pipe 4,7,12 is determined precisely as to not have an excess amount such that the heat pipe will inflate to its maximum extent and not burst the seals when the heat pipe is heated above its boiling point. The choice of working fluid can be mixtures of different fluids that are aziotropes that achieve a desirable boiling point such as 5% water and pentane with a boiling point of 34.6° C. By establishing a heat pipe 4,7,12 boiling point with an impurity gas or though the pressurization via the flexible walls of the heat pipe the heat removal will only occur above the boiling point of the working fluid. This prevents the heat pipe from removing heat bellow the boiling point, so that it acts like an automatic thermostat and does not remove heat when the wearer surface 14 is cold. The heat pipes can be formed into a network to cover the head and extend out into the exterior air 7, 12, either through the helmet via 15 a vent hole or around the rim of the helmet shown in FIG. 1. The heat pipes will be filled with the working fluid and a wicking material 4 to redistribute the liquid working fluid by capillary action back to the heat source. These wicking materials can be silk or finely woven stainless steel mesh. In some situations such as in a helmet the wicking material inside the heat pipe 4 can be deleted if the helmet 2 or application is oriented in gravity such that the liquid return of the working fluid is back down to the heat source (the head 13). This can lead to a beneficial situation that if the outside air 8, is hotter than the human 13 there will be no liquid on the high area of the heat pipe 7 and it will be able to boil fluid and transfer heat from the outside environment to the inside the helmet 3, 14. This can be very important to not transfer heat into the human 13, such as when there is fire on the outside of the helmet 2 or armor. To control the airflow 1 through the helmet laminate actuators 5,6,9,11 are made of two layers such as a polyester substrate film 6 which has a low to negative thermal expansion coefficient and the temperature or humidity expanding material layer 5 such as Nylon (Wright Coating Co., 1603 North Pitcher St., Kalamazoo, Mich. 49007), Nafion (Sigma-Aldrich Co., 3050 Spruce St., St Louis, Mo., 63103) or an aromatic polyetherketone resin having protonic acid group (US Patent application 20040191602 Mitsu Corporation, 580-32 Nagaura, Sodegaura-City, Chiba 299-0265, Japan), for expansion with high humidity or polyethylene for expansion with high temperatures. The laminate actuators 5,6,9,11 can be placed such that they block the airflow out 10 of the exit apertures 15 when the interior of the helmet is low humidity or cold. When the humidity rises or the temperatures rise the apertures open 5,6,9,11. With the apertures open air flows 1,10 through channels 3 formed in the wick covered padding 4,14 and evaporation of sweat or water added to the padding in the helmet. Air flowing 1 over the exterior of the heat pipes cools the heat pipes and removed heat from the surface 14 of the wearer 13. To draw air out though the vent 15 in the top of the helmet 2 a venturi flow 10 constriction and hole 15 can be formed with the heat pipe 7 or a vent cover 16,17. The high velocity flow causes the pressure to be lowered and draw air out of the top of the helmet 2. Other arrangements such as with motorcycle helmets is to direct the vent cover open such that face away from the air flow 8 direction as illustrated vent 16,17 and draw air through the aperture 18 the actuator 16, 17 when opened. To moderate or control the cooling of the heat pipe that is outside the helmet a laminated actuator cover or variable insulation layer 16,17 can be placed over the heat pipe 7. This laminate actuator layer or layers 16,17 can react to temperature alone, in contrast to the laminate actuators 5,6,9,11 on the inside of the helmet or body armor that react to humidity or temperature. These exterior laminated actuators, as an example, are made with a lamination of polyester substrate layer 17 with a low coefficient of thermal expansion and a polyethylene layer 16 with a high thermal expansion coefficient. The laminate actuator sheet 16,17, fibers, or polymorphic surface are cut to form flap valves or random hair like actuation. Flap actuators 16, 17 and apertures 18 can be formed to close and block air flow through the aperture 18. In both cases the laminate actuators interfere with flow of air and flow over heat from the heat pipe 7. These thermal actuated laminate actuators 16, 17 placed on the outside of the helmet or armor 2 can be a fabric like material that expands and traps air 19 when exterior temperatures or low and allows air flow 18 when temperatures are high. Thermally conductive materials such as graphite sheets, fibers, copper wires, copper foils, aluminum wires, or aluminum oxide can be incorporated into the padding foam 4, 14 or substituted for the heat pipes 7 to move heat away from the wearer to the water evaporating areas or outside the helmet 2. The thermally conductive materials or rigid heat pipes 12 exposed to the outside air flow 8 have the disadvantage that if they are taken to the outside the helmet can remove or add heat to the wearer, but are simple to construct compared to the heat pipes. To correct this disadvantage a laminate actuator cover 16,17, as shown covering the heat pipe on the top of the helmet 7, can thermally insulate the heat pipe 7 when temperatures are low.

In operation of the helmet air flows 1 into the channels of the padding 14, 4 of the helmet removing some heat through the padding by heating up the incoming air, if the outside air is cooler than the wearer. Additional cooling occurs from the evaporation of sweat which is wicked 14 through silk or COOL MAX® (Intex Corporation, 1031 Summit Ave. Greensboro, N.C. 27405) onto the surface of the padded heat pipes into the air flow channels 3. The air flow 1 is blocked by the laminate actuators 5,6,9,11 if the humidity or temperatures are low in the helmet 2. If the humidity or temperatures are high the laminate actuators 5,6,9,11 open and air flows 1 and evaporative cooling occurs and heat is removed from the surface of the wearer 14 via the heat pipes of thermally conductive pads 4. The moisture laden air flow exits 10 from the helmet though vent holes 15 or out though the back rim valves 11 of the helmet 2. Air flow movement is expected to be driven by thermal convention or forced by the motion of the wearer on a motorcycle or vehicle. Later drawings will show how the air flow can be forced through the padding channels with a fan or pump.

Figure 2:
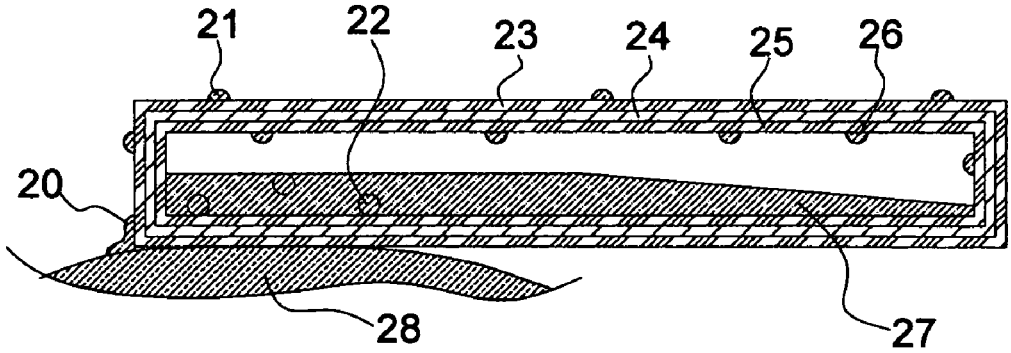

In FIG. 2 a cross sectional view of the wick covered heat pipe is shown in contact with a wearer's skin or body. In this diagram the heat pipe 24, 25,22,26,27 draws sweat 20 off the surface of the wearer 28 where the heat pipe makes contact with the wearer's skin. The sweat 21 wicks over the surface of the heat pipe through the silk covering of the heat pipe 23. On the surfaces of the heat pipe that is exposed to flowing air the sweat 21 evaporates and the cools the surface of the heat pipe. Inside the heat pipe the working fluid condenses 26 and delivers heat through the heat of condensation of the working fluid 27. While on the contact area with the wearer 28 the working fluid liquid boils 22 and removes heat from the surface of the wearer 28 via the heat of vaporization. Heat can also be removed from the surface of the wearer 28 through the heat pipe to the cooler surroundings without evaporating sweat 21 off the surface of heat pipe. The heat pipe walls 24 are formed by heat sealing an aluminum layer or copper layer lined polyester polyethylene sandwich material (Vendor address). An inner wicking liner 25 is placed inside the heat pipe such as silk fabric, polyester fabric, open cell urethane foam, or fine woven stainless steel mesh.

Figure 3:
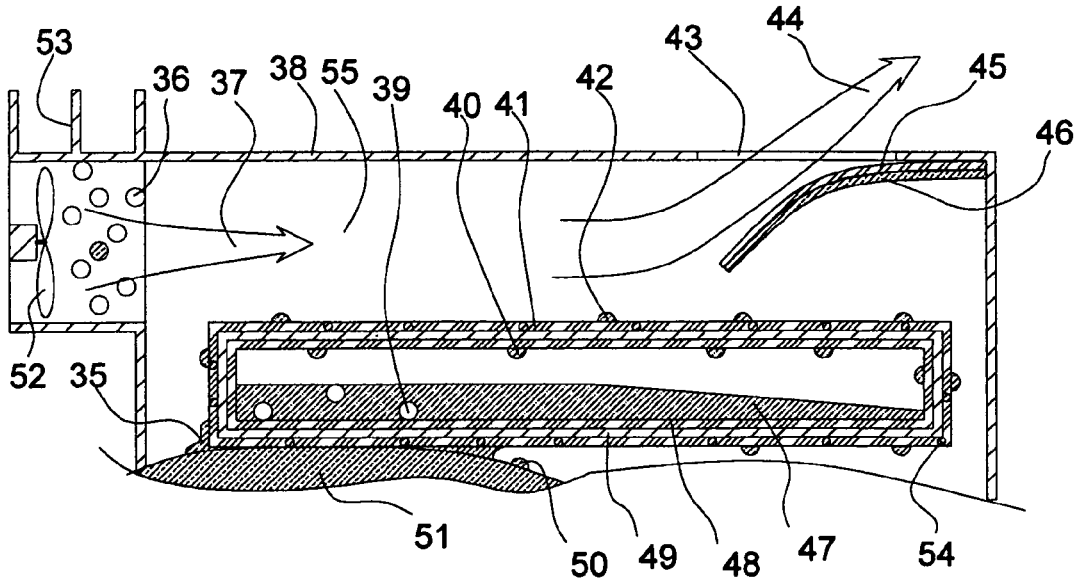

In FIG. 3 a wick covered heat pipe inside a helmet or armor shell with air flow and actuating valve are shown. In this example the heat pipe 49 is part of the padding of the helmet or armor 38 and is pressed against the wearer 51. Sweat 50 from the wearer 51 is wicked from the surface of the skin 35 and through the wicking fabric 41 of covering the heat pipe 49. The sweat 42 wicks to the surfaces of the heat pipe/padding 41 to be exposed to the air flow channels 55 in the helmet 39. The air flows 37 through an air intake and out 44 through a vent port 43. In this example a de-humidifier 53 filled with a material such as zeolite beads or a salt 36 that absorbs water vapor from the air. With this absorption the heat of condensation and heat of interaction is delivered on the zeolite or salt 36. This heat is then conducted to heat fins 53 and dissipated into the surroundings. A fan or pump 52 can be used to force air flow 37 through the dehumidifier and air flow channels 55. If the wearer 51 is traveling through the air their may be sufficient rammed air pressure and subsequent air flow 37 through the dehydrator and the air flow channels 55 to cool the wearer 51. Thus, the fan or pump 52 may not be needed. In situations where the wearer 51 is stationary, the fan or pump 52 may be necessary to achieve sufficient air flow to cool the wearer 51. A laminate actuator valve 43,45,46 is shown in this example. It is formed by a lamination of polyester plastic film 46 coated at the bending areas with, Nylon, aromatic polyetherketone resin, or other humidity swelling plastic film 45. Temperature actuation could be enabled by laminating on the actuator a plastic film 45 such as polyethylene which has a high thermal coefficient of expansion. Both thermal expansion and humidity expansion materials could be laminated onto the actuator substrate film 46 to produce temperature and humidity actuation with changes in temperature and humidity. The laminate actuator 45, 46 covers its aperture 43 when humidity or temperatures are low and uncovers the aperture 43 when humidity or temperatures are high. This allows air to flow 37 though the air channels in the padding 55 and out 44 through the vent hole 43. This in turn allows sweat 42 to evaporate and cool the surface of the heat pipe 41, 49 and the heat pipe 49 in turn cools the surface of the wearer 51, by boiling a working fluid 47. A working fluid 47, such as pentane is wicked onto the inner surfaces of the heat pipe 49 with a silk or polyester liner fabric 48. The working fluid 47 boils 39, removing heat, at the thermal contact of the wearer 51, and then deliverers' heat by condensation 40 to the sweat 42 in the wick cover 41 on the heat pipe 49 when it condenses 40. Then as the air is flows 37, 44 past the water wicked surface 42 on the outer surface of the heat pipe 49 heat is removed by vaporization of the sweat 42. A biocide such as silver coatings or photoreactive titanium dioxide particles or films 54 are deposited into and onto the wicking fabric 41 on the heat pipe 49. The biocide 54 is added to block the growth of bacteria or fungus on the wicking surfaces 41 because they are moist and may be impregnated with dead skin, body fluids, and sweats from the wearer 51 and provide ideal growth environment for bacteria and funguses.

Figure 4:
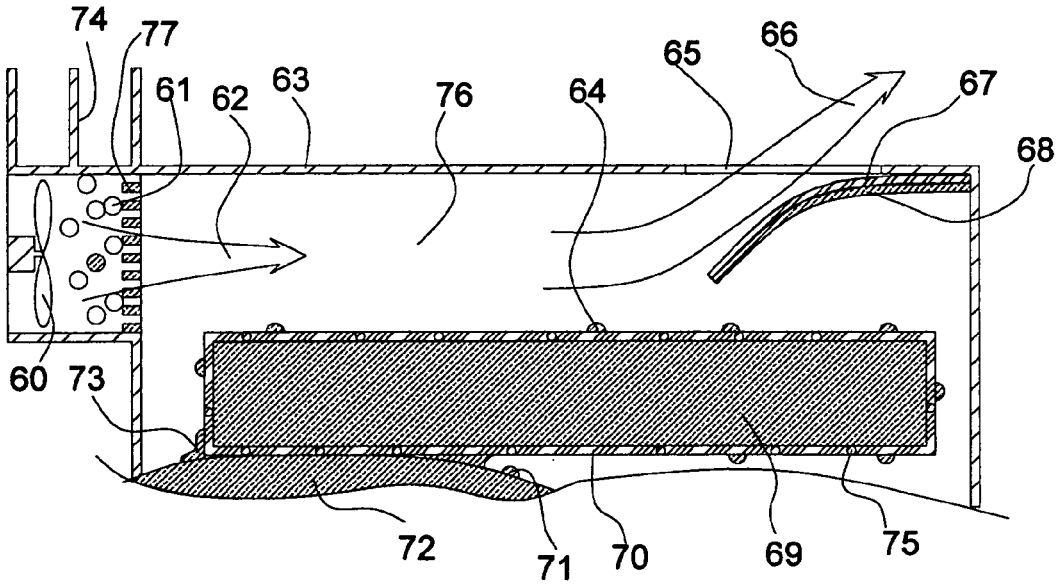

In FIG. 4 wick covered thermally conductive padding dehydrating air flow and laminate actuator are shown. In this example the padding 69 on the wearer 72 is thermally conductive and a conduit for heat flux such as radiant heat transfer, fluid circulation (convection), electron conduction (metals), and phonon heat transfer (electrical insulators). The thermal conduit padding 69 can be open cell urethane foam loaded with graphite, aluminum oxide, or copper powder, closed cell silicone rubber, closed cell neopreame rubber, closed cell polystyrene foam, or closed cell urethane rubber foam. The padding 69 can also be a bladder filled with a, powder, beads, liquid, or jelly such as silicone gel Beta Gel (Geltec Corporation, Ltd, Shinagawa TS Bldg. 2-13-40 Konan Minato-ku, Tokyo 108-0075, Japan). Materials such as graphite powder, graphite fibers, carbon nano-tubes, aluminum wires, aluminum fibers, magnesium powder, silver powder, silver wires, copper wires, copper powder, silicon carbide powder, zirconium oxide powder, aluminum oxide powder, and water gels, can be incorporated into the padding 69 to increase the thermal conductivity. The thermal conductive material 69 can act to homogenize the temperature environment contained behind the armor which can be useful when certain parts of the armor are exposed to different temperatures and heat loss environments such as in gloves and shoes, where the finger tips and toes are cold and the palms and ankles may be hot. There are physiological situations where the human or animal body reduces or has reduced blood flow to the extremities and the external redistribution of heat to the extremities can be useful. The padding 69 is covered with a wicking material 70 such as silk fabric or hydrophilic treated polyester fabric such as COOL MAX®. The wicking fabric 70 can be coated with a photo catalytic titanium oxide coating (TPXsol, KON corporation, 91-115 Miyano Yamauch-cho, Kishima-gun Saga prefecture, Japan) 75 to achieve a high surface energy and wet-ability. This wetting coating 70 such as photo catalytic coating can also act as a biocide killing bacteria and fungus on contact. Silver coatings 75 on the wicking material 70 can also be used as a biocide. The air inlet contains loosely packed beads or cadged beads of moisture absorbent material 61 such as a zeolite, silica gel, or calcium oxide that remove moisture from the inlet air as it flows through. This air inlet bed 61,77 can also act to filter out insects, dust, rain, snow, bacteria, and dirt from the air flowing into the channels in the padding 76 and incorporate techniques such as network mesh filter such as expanded Teflon and/or electrostatic filter such as parallel sheets of charged electrets of silicone rubber 77. The dehydration of the air flow 62 may be useful in high humidity environments but may be less useful in environments where the relative humidity is below 50%. The heat of condensation of the moisture and the reaction of the moisture with the moisture absorbent 61 is conducted to the armor walls 63 of the dehydrator and dissipated to the environment through cooling fins 74. A fan or pump 60 is used to push air through the dehydrator particles 61 and channels 76 in the padding. The fan or pump 60 could be linked to the laminate actuator 67, 68 to only operate when the laminate actuator valve 65, 67, 68 has opened and air will flow through the system. In some situations thermal convection of air flow or just the motion of the wearer may be sufficient to move air through the air channels 76 to effectively cool the wearer 72. A laminate actuator valve 65, 67, 68 is shown in this example formed by a lamination of a polyester or polyimide plastic film 68 coated at the bending areas with Nylon, aromatic polyetherketone resin or other humidity swelling plastic film 67. Temperature actuation could be enabled by laminating onto the substrate film 68 an actuating plastic film 67 such as polyethylene which has a high thermal coefficient of expansion. Both thermal expansion and humidity expansion materials could be laminated onto the substrate film 68 to produce temperature and humidity actuation with changes in temperature and humidity. The laminate actuator 67, 68 covers the opening 65 when humidity or temperatures are low and uncovers the opening 65 when humidity or temperatures are high. This allows airflow 62, 66 though the channels 76 in the padding 69 and out through the vent hole 65. This air flow allows sweat 64 to evaporate and diffuse water molecules into the dry incoming air, and cool the wicking surface 70 of the thermally conductive pads 69 which in turn cools the surface of the wearer 72. Sweat 71 from the body 72 is wicked through the cloth cover 70 to the outer surfaces 64 of the thermal conductor 69. When the temperatures or humidity inside the helmet 63 is low the laminate actuator valve 65, 67,68 closes and air flow 66 is blocked or impeded. This air flow blockage or impedance reduces the heat flux lost from evaporation, diffusion, and convection and maintains comfortable conditions inside the helmet 63.

Figure 5:
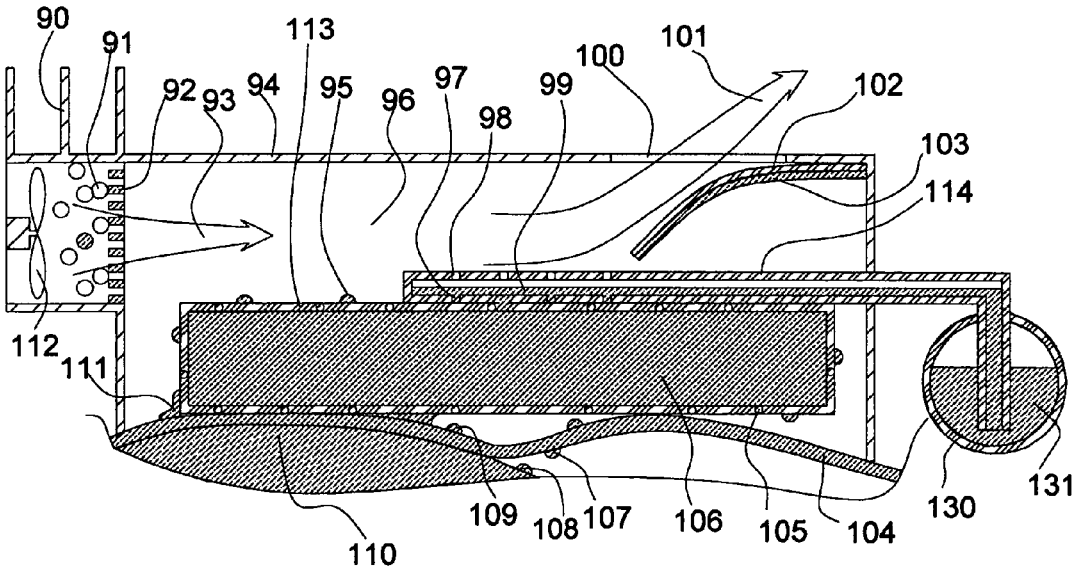

In FIG. 5 the cooling system with supplemental water supply for evaporation and a fabric or membrane layer between the wearer and the thermal conductor is shown. In this embodiment of the invention the features of the wicking material 113 on thermally conductive padding 106 is shown. A humidity or temperature activated laminate actuator valve 102, 103 are shown covering an exit aperture 100 in the armor shell 94. An air flow intake fan 112 with dehydrator beads bed 91 and conduction and convection cooling fins 90 on the exterior of the dehydrator is shown. In certain situations supplemental evaporative cooling may be very desirable for this invention. These are situations where the cooling needs tax the wear to sweat sufficiently or the wearer needs to be isolated from the external air such as in hazardous environmental suits. Thus, to provide this higher cooling capacity evaporative cooling water can be distributed onto the wick 113 on the thermally conductive padding 106 through tubes such as polyurethane (Stevens Urathane, 412 Main Street, Easthampton, Mass. 01027) or silicone rubber tubing 114 (Silicone Specialty Fabricators, 222 Industrial Park Drive, Elk Rapids, Mich. 49629). A network of tubing with open exits or tubes with small pores, 98, 97 can distribute water to the wicking material 113 on the thermal conductors 106 in the air flow passages 96. Other alternative methods of delivering the supplemental water is through a water permeable membrane such a thin walled polyurethane tubing 114 or though a hydrophobic porous water vapor permeable membrane of expanded Teflon or GORE-TEX® (W.L. Gore & Associates, Inc., 295 Blue Ball Road, Elkton, Md. 21921). In all three cases the water distribution system tubes 114 should be in physical contact or thermal contact with the thermal conductive padding 106 to be able to conduct heat from the wearer 110 to the evaporative cooling sites 95. These supplemental fluid tubes 114 could also be sealed tubes or a portion being sealed and the chilled fluid or heated fluid 124 circulated throughout the helmet or body armor 94. A pump 123, such as a hand squeeze elastic bladder, could be used to circulate or oscillator the fluids into the tubes 114. Another configuration that will be used in many situations is that the wearer 110 has a wicking fabric 104 covering their skin such as silk or micro fiber polyester COOL MAX® and the sweat route 108, 107, 109, 111 and thermal contact must go through this fabric covering. This layer interface between the wick covered thermal conductor 113, 106 and the wearer 110 may also be a membrane 104 such as polyurethane or silicone rubber membrane to allow water 107, 109 to diffuse through but not allow bacteria or viruses through. This membrane 104 could be a porous hydrophobic liquid water blocking membrane that would allow vapor through while not allowing liquid water to flow through such as with expanded Teflon, or GORE-TEX® fabric. The membrane 104 could also be an impermeable barrier such as neoprene rubber or stainless steel plate where only heat removal is desired. When the water transport 108, 107,109,111 from the wearer 110 to the wick covered thermal conductor 106, 113, 95 is done with a selectively permeable membrane 104 such as an cellulose nitrate, osmotic membrane (Membrane Process Engineering, 3-3-3 Akasaka, Minato-Ku, Tokyo, Japan) or a vapor transport membrane such as expanded Teflon a salt or water vapor pressure reducing material such as sodium chloride, cotton, titanium dioxide, or Nafion polymer electrolytes 105 can be coated or incorporated into the wicking material on the thermally conductive padding 106. This creates a vapor pressure gradient, surface tension energy gradient, with the higher surface tension energy on the evaporation sites 95, or ionic concentration gradient to draw water from the wearer to the wicking covering material 113. This can keep the wearer's surface 110 dry and comfortable. In operation the supplemental water 99 distribution 97, 98 from the tubes 114 and wicking materials 113 could be provided for on demand or thorough sensors built into the laminate actuators 102, 103 that sense excessive temperatures. The fan 112 can also be activated through the same laminate actuator sensor 102, 103. When temperatures are low the laminate actuator could cover the aperture 100 and stop the evaporative cooling 95, 98 and the fan 112 would shut off to thermally insulate and conserve heat of the wearer 110. In operation air is drawn through the water absorbent 9 and electrostatic filter 92 with a fan 112. This insures that the air flow 93 is dry and clean. The airflow 93 through the channel between the conductive pads 106 and armor 94. Evaporation of water occurs on the surface of the wick 113 and the supplemental fluid tubes 98. If the temperatures are high the laminate actuators 102, 103 will open and let the exit air flow 101 through the aperture 100.

Figure 6:
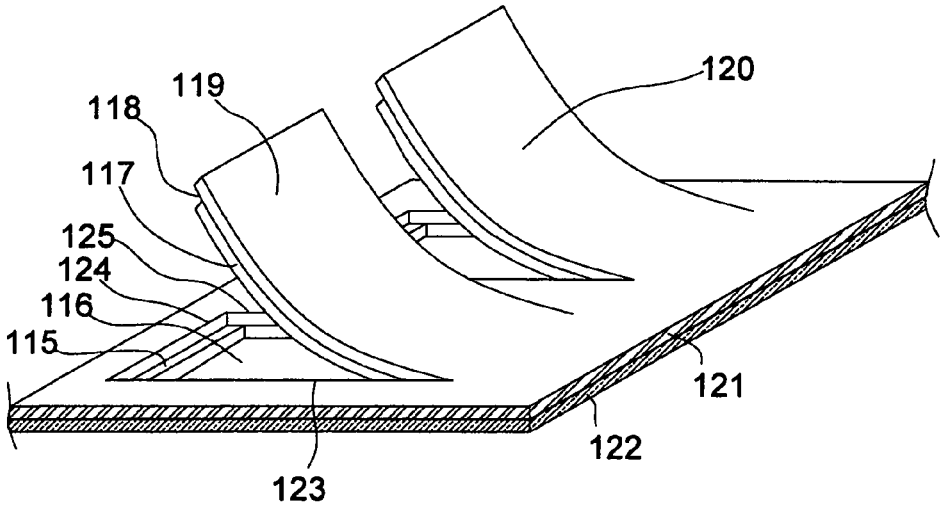

In FIG. 6 a sample of sheet of laminate actuator valves is shown. The constructions of these laminate actuators are formed out of two or more films of materials 121, 122 that have different expansion properties and are laminated together. The different expansion properties of the two films 121, 122 lead to shear stress between the two films. To relieve this stress laminated films will curl once they find a preferential curl or non-constrained direction. If the laminate sheet is cut into patterns such as the three right angle cuts 123, 124, 125 as shown in FIG. 6 the laminate will curl into a flap arrangement 117, 119, 120 that has a preferential fold determined by the geometry of the cut pattern and the laminated material deposits. The aperture 116 left by the cut can act as the aperture of a valve when the flap presses back into the aperture 116. A shelf 115 can be cut or formed into the substrate 121 and the flap 118 such that the flap can only open one direction and creates a seal with the aperture 116 when the actuation goes in the opposite curl direction. An example of a laminate actuator construction is to thermally bond a 25 micron thick sheet of polyester 121 with a low thermal expansion coefficient to a 75 micron thick sheet of polyethylene 122 with a high coefficient of expansion. In this particular example the flaps or actuators 119, 120 would curl open when hot and curl closed when cooled to press the notch on the flap 118 to the shelf 115 on the aperture 116. Laminated actuator structures can be cut with many patterns such as two right angle cuts, three angles cuts that form flaps and apertures. Laminate actuators can be formed and cut on two or three dimensional surfaces such as fibers, cylinders and polymorphic surfaces. Our patent Application U.S. 60/765,607 describes a host of cut patterns, geometries of laminate actuator valves. These valves are auto-actuating valves and auto-changing structures that change with changes in temperature, relative humidity, chemical, electrical, and light environments. Mesh support materials or shelves 115 can be laminated onto the apertures 116 to create screens as flap stops to prevent the flap from curling through the aperture and opening in the opposite direction. These laminated actuator valves and structures can range in size from many centimeters nanometer dimension hairs. The actuators can be effective as hairs that actuate and created impedance to fluid and thermal flow or fluff layers of actuators to effectively increase thermal insulation by pushing each layer apart to create stagnant cavities of fluid (gasses or liquids). The laminate actuated structures can also include coiling and uncoiling fibers and strips.

Another construction example of a laminate actuator is to form the laminated layers with a porous polyester substrate or polyethylene 121 and a temperature or humidity expanding material layer 122 such as Nylon, Nafion, or an aromatic polyetherketone resin having protonic acid group for expansion. The porosity of the substrate 121 can enhance the adhesion between the layers and also increase the sensitivity to moisture by allowing diffusion through the substrate membrane 121 to the expanding material layer 122. The expanding material layer 122 is coated onto the one side of the polyester substrate 121. Specific deposit patterns and thicknesses of the expanding layer 122 can be used to efficiently utilize the expansion polymers and create effective actuation patterns. Additional layers of coatings and electrodes such as piezoelectric materials can be deposited on the substrate 121 or expansion layers 122 such as a piezoelectric material of polydifluoethylene (PDVF), and electrodes such as vapor deposited platinum films, or sliver print. These additional coatings can provide for functions to act as sensors to the relative humidity, temperature, or be electrically stimulated to open the actuators or cause them to oscillate and pump air flow.

Physical elements of this invention include:

1. Wick contact with living body
2. Heat pipe or thermal conductor or conduit in contact with living body
3. Air flow in channels
4. Evaporative cooling in the air flow channels and on heat pipes or thermal conductors.
5. Using flexible or elastic heat pipes pressure equilibrium with the external atmosphere to set the boiling point of the working fluid.
6. Using impurities in the heat pipe working fluid to set the boiling point of the working fluid inside the heat pipes.
7. Heat pipes without wicks and gravity orientation to act as one way heat delivery systems and avoid heat flow back to the wearer.
8. Humidity or temperature auto-reactive laminate actuator structures and/or valves to control air flow to try and achieve more constant temperature or humidity conditions, by impeding air flow when dry or cold and reducing impedance when humid or hot.
9. Humidity or temperature auto-reactive laminated actuator structures to achieve self adjusting variable thermal insulation to achieve more constant temperature by increasing thermal resistance when dry or cold and decrease thermal resistance when humid or hot.
10. Covering the living body padding with a plurality of reactive laminate actuator valve arrays or actuated structures such as curling hairs.
11. Covering the exterior of the helmet or body armor to achieved self adjusting variable thermal insulation.
12. Delivering extra liquid water or a fluid for evaporative cooling inside the helmet or armor to the wicking padding on the thermal conductors or heat pipes.
13. Fluid flow systems that can also be used to deliver hot or cold fluids to the inside the helmet or armor.
14. Delivering liquid water and evaporation through a membrane for cooling inside the helmet or armor.
15. Coating the wicking materials with biocides and fungicides.
16. Using a fan or pump to push air flow or fluid flow through the channels in the helmet or body armor.
17. Using a moisture absorbent to remove moisture from the air entering the helmet or body armor.
18. Using a filter and/or electrostatic filter to remove contaminants from the air flowing into the helmet or body armor.
19. Using a wicking covering over the living body.
20. Using a selectively permeable membrane between the living body and the air flow passages.
21. Using ionic concentration gradients to draw water away from the living body surface.
22. Using surface tension gradients to draw water away from the living body surface.
23. Using the position and geometry of air flow vents with respect to the helmet or body armor air flow environment or gravity orientation to achieve high air flow rates and convective air flow rates in the channels in the helmet or body armor.
24. Using a pump to move supplemental fluids into the helmet or body armor to for supplemental evaporative cooling or circulating cooled or heated fluids.

While this invention has been described with reference to specific embodiments, modifications, and variations of the invention may be constructed without departing from the scope of the invention.

The invention claimed is:

1. Wearable heat and moisture control apparatus comprising an outer wearable member, air flow channels, having inlet air flow and outlet air flow, inward of the outer wearable member, a thermal conductor inward the air flow channels, water wicking material covering the thermal conductors next to a body of a wearer and humidity or temperature reactive auto actuated laminate valves or impedance structures for varying movement of heat, wherein the thermal conductor is a heat pipe that conducts heat away from the body of the wearer.

2. The apparatus of claim 1, wherein the outer wearable member is an armor shell, wearing apparel or a helmet.

3. The apparatus of claim 1, further comprising water vapor absorbents in the inlet airflow.

4. The apparatus of claim 3, wherein the biocides are made of silver, silver oxides, or photo catalysts of titanium oxides.

5. The apparatus of claim 1, further comprising a particulate filter or an electrostatic filter on the inlet air flow.

6. The apparatus of claim 1, further comprising a fan or air pump connected to the airflow channels.

7. The apparatus of claim 1, further comprising a membrane or fabric between the water wicking material covered thermal conductors and the wearer.

8. The apparatus of claim 1, further comprising a source of water and distribution system besides the wearer.

9. The apparatus of claim 1, further comprising a biocide or anti bacterial or anti fungal coatings, hydrophilic, or materials on the wicking material.

10. The apparatus of claim 1, further comprising a water vapor pressure reducing material or surface tension energy increasing materials in the wicking material.

11. The apparatus of claim 1, further comprising a photo catalytic coating on the wicking material that is hydrophilic and maintains its hydrophilic properties by exposure to light.

12. The apparatus of claim 11, where the photo catalytic coating material is titanium dioxide.

13. Apparatus of claim 1, wherein the heat pipes are flexible and sealed with an internal working fluid and internal gas pressure is near external atmospheric pressure to define a boiling point of the working fluid, or wherein the heat pipe is rigid and uses an impurity gas pressure to set a boiling temperature in the heat pipe.

14. The apparatus of claim 13, wherein the heat pipe has an internal wick to move liquid working fluid by capillary action.

15. The apparatus of claim 1 wherein the laminate auto-actuated impedance structure or laminated auto-actuated valves increases by actuation of the heat or fluid flow impedance when the relative humidity is low inside the space between the outer material and decreases by actuation of the heat or fluid flow impedance when relative humidity is high inside the space between the armor shell, or helmet covering human or animal.

16. The apparatus of claim 1, wherein the laminated auto-actuated impedance structure or laminated auto-actuated valve increases by actuation the heat flux impedance, diffusion flux impedance, or fluid flow impedance when the surrounding temperature is low inside the space between the armor shell, or helmet covering human or animal and decreases the heat or fluid flow impedance when temperature is high inside the space between the armor shell, or helmet covering human or animal.

17. The apparatus of claim 1 where the laminate auto-actuated impedance structure or laminate auto-actuated valves increases, by actuation, the heat flux, diffusion flux impedance, or fluid flow impedance when the surrounding temperature and humidity is low and decreases the heat or fluid flow impedance when surrounding temperature and humidity is high.

18. The apparatus of claim 1 where the laminate auto-actuated impedance structure or laminate auto-actuated valves increases, by actuation, the heat or fluid flow impedance when the temperature outside armor shell, or helmet covering human or animal is low and decreases by actuation the heat or fluid flow impedance when temperature outside the space between the outer wearable member and the wearer are high.

19. The apparatus of claim 1 where the auto-actuated impedance structures or auto-actuated valves comprise of a substrate layer and an actuator layer cut or deposited into a pattern to form the fluid and heat impedance structures of flaps covering or un-covering apertures, curled hairs, coiled hairs, space separating membranes, or space separated membranes offset apertures in membranes with curling flaps separating.

20. The apparatus of claim 1, wherein the auto-actuated valves or auto-actuated impedance structures comprise laminate structures made of the substrate layer of low or negative expansion coefficient layer and a high or positive expansion coefficient layer cut or deposited into a pattern to form the impedance structure or air vents and mated to a vent aperture or apertures.

21. The apparatus of claim 20 wherein the air vents are made of a laminate of substrate layer of polyester, polyaramide, or polyimide plastics and an expandable and contractable material on the substrate layer that expands and contracts with relative humidity made of Nylon Nafion, aromatic polyetherketone resin, or, aromatic polyetherketone resin having protonic acid group.

22. The apparatus of claim 1, wherein the actuated valves comprise laminate actuators are made of the substrate layer of low or negative coefficient of expansion layer and a high or positive expansion coefficient layer cut into a pattern to form the fluid and heat impedance structures of curled hairs, separated membranes, or membranes and apertures separated by curled flaps, curling spirals, and deforming polymorphic surfaces.

23. The apparatus of claim 1, wherein the auto-actuated laminate structures or auto-actuated laminate actuated valves cover the thermal of fluid flow conduits on the exterior of the armor, shell or apparel.

24. The apparatus of claim 1, wherein the heat pipe is made of copper tubing, or a sealed laminate of polyester membrane, aluminum membrane and polyethylene membrane.

25. The apparatus of claim 1, wherein the heat pipe uses a working fluid of hydrocarbons, pentane, butane, pentane and water, an azeotropic fluid mixture, chlorfluorocarbon fluid, trichloromonofluomethane, or fluorocarbons such as 1,1 difluroethane, 1,1,1,2-tetrafluroethane, perfluorhexane, 2-methyl perfluorpentane.

26. The apparatus of claim 1, wherein the thermal conductor conduit incorporates graphite, copper, silver aluminum, aluminum oxide, or zirconium oxide, into the urethane rubber, silicone rubber, neoprene rubber, polystyrene foam padding in thermal contact with the human or animal.

27. The apparatus of claim 1, wherein the heat pipe is without an internal wick or partial coverage of heat pipe interior.

28. The apparatus of claim 1, wherein the thermal conductors extends outside of the outer material which is an armor shell or helmet through holes or around edges of the armor shell or helmet.

29. The apparatus of claim 1, wherein the outer wearable member comprises a helmet, shell, body armor, or apparel, the air flow channels are formed with titanium dioxide coated silk fabric covered graphite loaded polyurethane foam, the thermal conductor is a laminated polyethylene film-aluminum foil-polyester film sealed flexible heat pipe with pentane working fluid and a heat pipe interior lined with polyester fabric in contact with wearer, and the valves or impedance structures comprise an auto-actuated laminate actuator placed in the air flow channels that has at least two crossing cuts in a laminate membrane of a polyester membrane laminated with a polyethylene film or an auto-actuated laminate actuator placed in the air flow channels that has a porous polyester membrane with deposits on one side of aromatic polyetherketone resin with two cross cuts.

* * * * *